US008668551B1

(12) United States Patent
Folino

(10) Patent No.: US 8,668,551 B1
(45) Date of Patent: Mar. 11, 2014

(54) GARMENT STRAP CLASP SYSTEM

(76) Inventor: Jennifer L. Folino, New Port Richey, FL (US)

( * ) Notice: Subject to any disclaimer, the term of this patent is extended or adjusted under 35 U.S.C. 154(b) by 342 days.

(21) Appl. No.: 12/806,980

(22) Filed: Aug. 25, 2010

(51) Int. Cl.
*A41C 3/00* (2006.01)

(52) U.S. Cl.
USPC ..... 450/86; 450/1; 2/338

(58) Field of Classification Search
USPC ..... 450/86, 1; 2/336, 338; 24/200, 198, 172
See application file for complete search history.

(56) References Cited

U.S. PATENT DOCUMENTS 2,099,199 A * 11/1937 Devendor et al. ..... 24/198
2,278,153 A * 3/1942 Shaulson ..... 24/200
3,177,541 A * 4/1965 Derrickson ..... 24/200
3,218,686 A * 11/1965 Rubenstein ..... 24/198
7,959,489 B2 * 6/2011 Shaffstall ..... 450/86

* cited by examiner

*Primary Examiner* — Gloria Hale

(57) ABSTRACT

A clasp has front and rear faces, an exterior periphery and an interior opening. The interior opening has upper and lower bearing surfaces. The clasp has joining surfaces coupling the bearing surfaces. A slot is formed in each clasp. The slot extends between the exterior periphery and a joining surface. Each slot has a width to allow loops of strap sections to pass through the slot between an operative orientation and an inoperative orientation. The operative orientation couples the strap sections with portions of the loops within the interior opening of the clasp in contact with the bearing surfaces. The inoperative orientation positions the strap sections exterior of the clasp.

1 Claim, 3 Drawing Sheets

FIG. 1
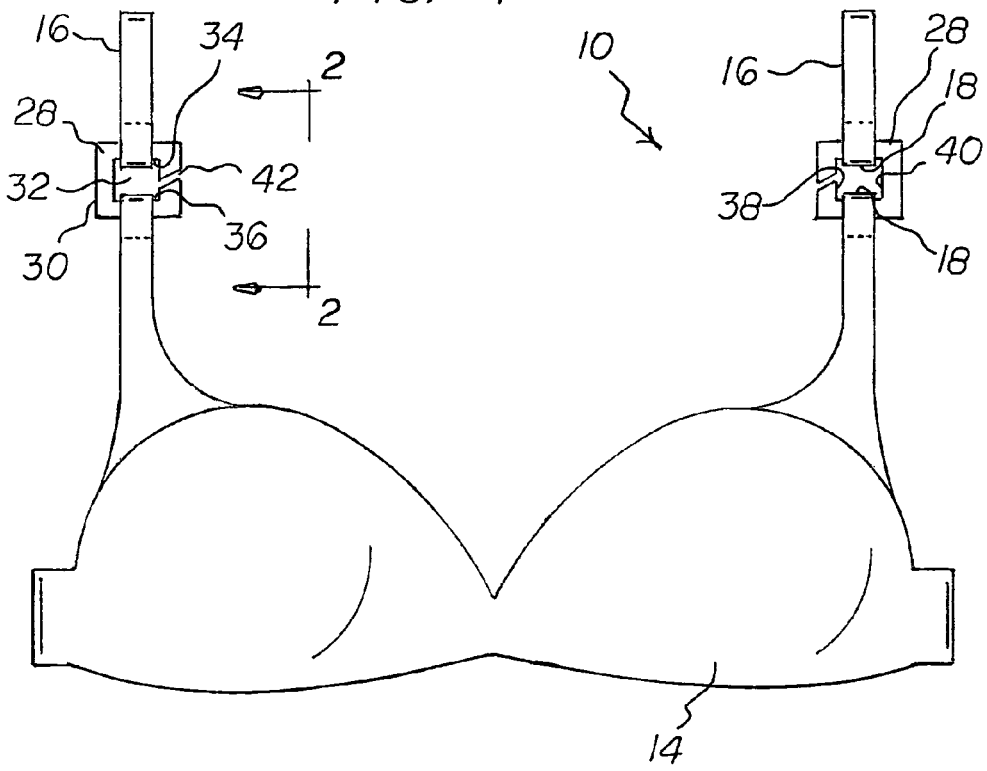
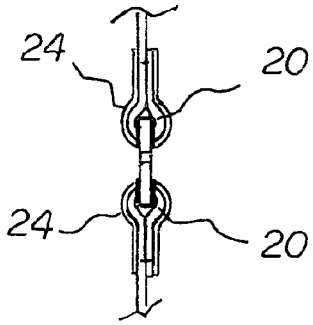
FIG. 2

FIG. 5
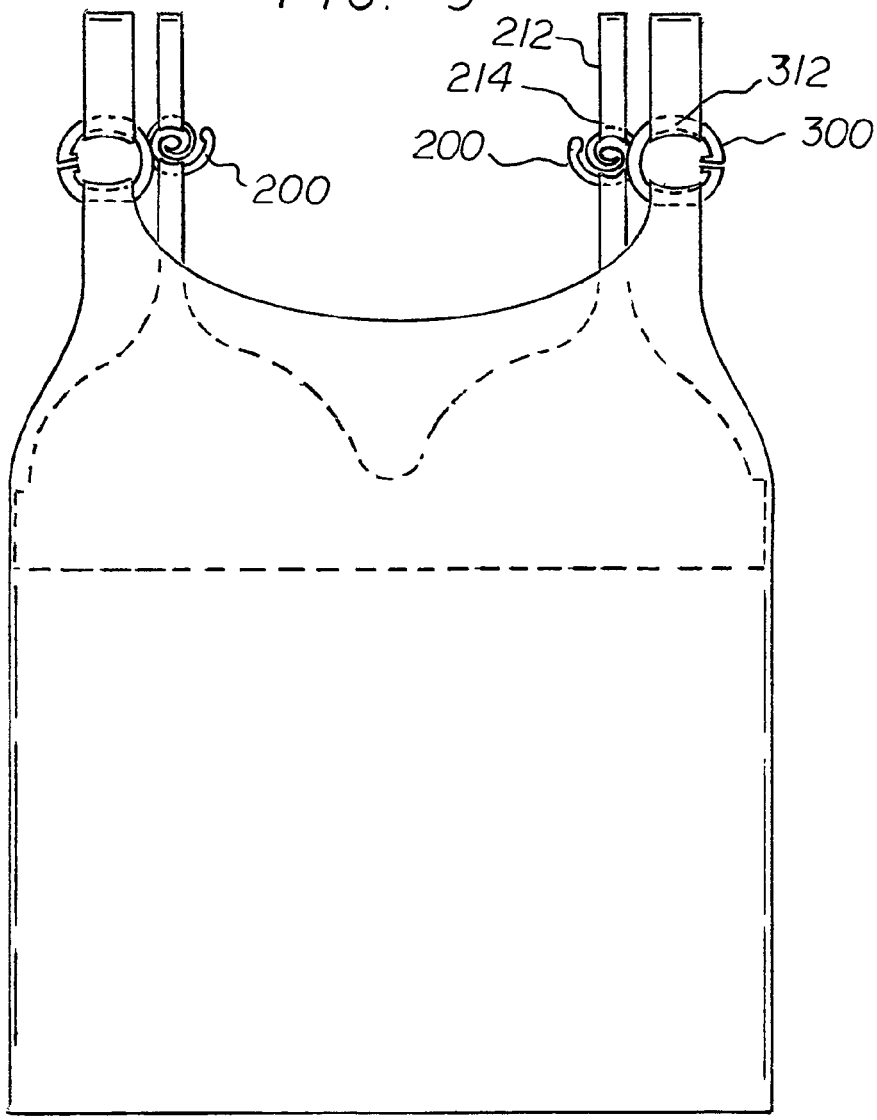
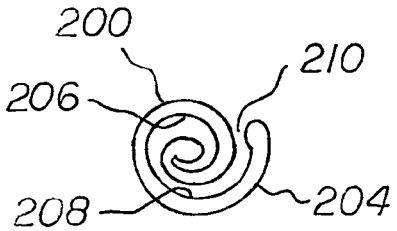
FIG. 6
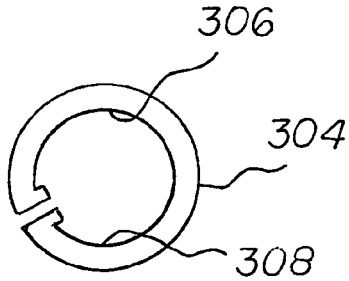
FIG. 7

GARMENT STRAP CLASP SYSTEM

BACKGROUND OF THE INVENTION

Field of the Invention

The present invention relates to a garment strap clasp system and more particularly pertains to coupling ends of bra straps, the coupling being done in a secure manner to preclude unintended separation, in a convenient manner to permit the simple replacement of clasps with respect to the strap ends and in an economic manner to allow a large number of clasp designs for any system.

SUMMARY OF THE INVENTION

In view of the disadvantages inherent in the known types of clasp systems of known designs and configurations now present in the prior art, the present invention provides an improved garment strap clasp system. As such, the general purpose of the present invention, which will be described subsequently in greater detail, is to provide a new and improved garment strap clasp system and method which has all the advantages of the prior art and none of the disadvantages.

To attain this, the present invention essentially comprises a garment strap clasp system. First provided is a bra. The bra has two straps. Each strap has two adjacent ends. Each end has a fixed loop of a common size. The straps include the loops. The straps are fabricated of a flexible fabric material.

A thin layer of a flexible elastomer is provided. The flexible elastomer covers the loops. In this manner durability is provided. Further in this manner the bra is provided with a lubricious surface.

Provided next are two similarly configured clasps. Each clasp has a front face. Each clasp has a parallel rear face. The front and rear faces are separated by a thickness. Each clasp has an exterior periphery. Each clasp has an interior opening. The interior opening has a linear upper bearing surface. The interior opening has a parallel linear lower bearing surface. The interior opening has an interior joining surface. The interior opening also has a parallel exterior joining surface. The interior and exterior joining surfaces couple the upper and lower bearing surfaces.

Provided last is a linear slot. The slot is provided in each clasp. The slot extends between the exterior periphery and the interior joining surface. Each slot is provided essentially midway between the bearing surfaces. Each slot is provided at an acute angle with respect to the bearing surfaces. Each slot has a width. In this manner adjacent loops of a bra strap are allowed to pass between an operative orientation and an inoperative orientation. The operative orientation couples the strap sections. In this manner portions of the loop are positioned within the interior opening of the clasp in contact with the bearing surfaces. The inoperative orientation positions the strap sections exterior of the clasps.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved garment strap clasp system which has all of the advantages of the prior art clasp systems of known designs and configurations and none of the disadvantages.

It is another object of the present invention to provide a new and improved garment strap clasp system which may be easily and efficiently manufactured and marketed.

It is further object of the present invention to provide a new and improved garment strap clasp system which is of durable and reliable constructions.

An even further object of the present invention is to provide a new and improved garment strap clasp system which is susceptible of a low cost of manufacture with regard to both materials and labor, and which accordingly is then susceptible of low prices of sale to the consuming public, thereby making such garment strap clasp system economically available to the buying public.

Even still another object of the present invention is to provide a garment strap clasp system for coupling ends of bra straps, the coupling being done in a secure manner to preclude unintended separation, in a convenient manner to permit the simple replacement of clasps with respect to the strap ends and in an economic manner to allow a large number of clasp designs for any system.

Lastly, it is an object of the present invention to provide a new and improved garment strap clasp system. A clasp has front and rear faces, an exterior periphery and an interior opening. The interior opening has upper and lower bearing surfaces. The clasp has joining surfaces coupling the bearing surfaces. A slot is formed in each clasp. The slot extends between the exterior periphery and a joining surface. Each slot has a width to allow loops of strap sections to pass through the slot between an operative orientation and an inoperative orientation. The operative orientation couples the strap sections with portions of the loops within the interior opening of the clasp in contact with the bearing surfaces. The inoperative orientation positions the strap sections exterior of the clasp.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a garment strap clasp system constructed in accordance with the principles of the present invention.

FIG. 2 is a side elevational view taken along line 2-2 of FIG. 1.

FIG. 5 is a front elevational view of a garment strap clasp system constructed in accordance with a final alternate embodiment of the invention.

FIGS. 6 and 7 are front elevational views of the clasps illustrated in FIG. 5.

The same reference numerals refer to the same parts throughout the various Figures.

DESCRIPTION OF THE PREFERRED EMBODIMENT

Figure 3:
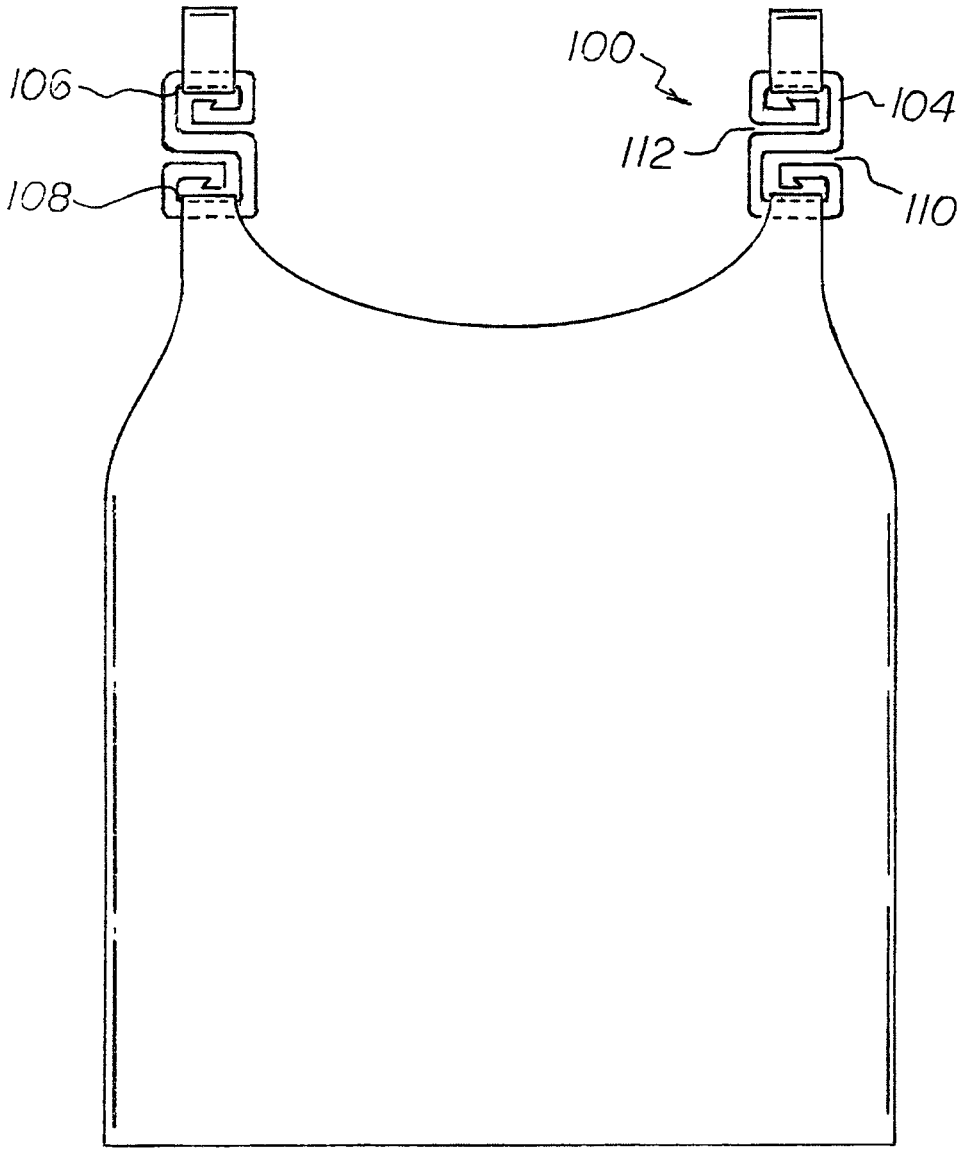
FIG. 3 is a front elevational view of a garment strap clasp system constructed in accordance with an alternate embodiment of the invention.

With reference now to the drawings, and in particular to FIG. 1 thereof, the preferred embodiment of the new and improved garment strap clasp system embodying the principles and concepts of the present invention and generally designated by the reference numeral 10 will be described.

The present invention, the garment strap clasp system 10 is comprised of a plurality of components. Such components in their broadest context include a clasp and a slot. Such components are individually configured and correlated with respect to each other so as to attain the desired objective.

First provided is a bra 14. The bra has two straps 16. Each strap has two adjacent ends 18. Each end has a fixed loop 20 of a common size. The straps include the loops. The straps are fabricated of a flexible fabric material.

A thin layer 24 of a flexible elastomer is provided. The flexible elastomer covers the loops. In this manner durability is provided. Further in this manner the bra is provided with a lubricious surface.

Provided next are two similarly configured clasps 28. Each clasp has a front face. Each clasp has a parallel rear face. The front and rear faces are separated by a thickness. Each clasp has an exterior periphery 30. Each clasp has an interior opening 32. The interior opening has a linear upper bearing surface 34. The interior opening has a parallel linear lower bearing surface 36. The interior opening has an interior joining surface 38. The interior opening also has a parallel exterior joining surface 40. The interior and exterior joining surfaces couple the upper and lower bearing surfaces.

Provided last is a linear slot 42. The slot is provided in each clasp. The slot extends between the exterior periphery and the interior joining surface. Each slot is provided essentially midway between the bearing surfaces. Each slot is provided at an acute angle with respect to the bearing surfaces. Each slot has a width. In this manner adjacent loops of a bra strap are allowed to pass between an operative orientation and an inoperative orientation. The operative orientation couples the strap sections. In this manner portions of the loop are positioned within the interior opening of the clasp in contact with the bearing surfaces. The inoperative orientation positions the strap sections exterior of the clasps.

Figure 4:
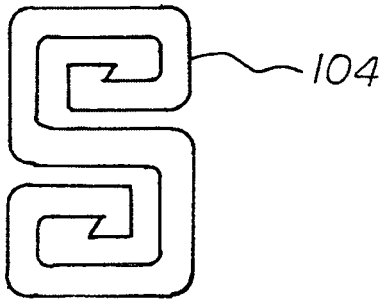
FIG. 4 is a front elevational view of the clasp illustrated in FIG. 3.

Note FIGS. 3 and 4. A clasp 100 is provided. The clasp is formed in a generally S-shaped configuration. An exterior periphery 104 is provided. The exterior periphery is in a generally rectangular shape. Bearing surfaces 106, 108 are provided. The bearing surfaces are linear. The slit means is a pair of opposed linear slots 110, 112. The slots are provided parallel with respect to the bearing surfaces.

Note FIGS. 5 and 6. The clasp is a primary clasp 200. The primary clasp is provided in a generally spiral-shaped configuration. An exterior periphery 204 is provided. The exterior periphery is in a generally circular shape. Bearing surfaces 206, 208 are provided. The bearing surfaces are arcuate. The slot means is a single space 210 in the exterior periphery. Loops 212 are provided. Bras strap ends 214 are also provided. The primary clasp adapted to couple the loops of the bra strap ends 214. A secondary clasp 300 is also provided. Note FIGS. 5 and 7. The secondary clasp is formed in a generally circular configuration. An exterior periphery 304 is provided. The exterior periphery is in a generally circular shape. Bearing surfaces 306, 308 are provided. The bearing surfaces are arcuate. The slot means is a single slot 310 in the exterior periphery. Loops 312 are provided. The primary clasp adapted to couple the loops of garment shoulder strap ends. The primary and secondary clasps are worn together in a laterally spaced relationship. Note FIG. 5.

It should be understood that the various clasps of the present invention are adapted to be fabricated of any of a variety of rigid or essentially rigid materials. Such materials include plastic and metal and composites. Similarly, the various clasps of the present invention are adapted to be fabricated of any of a variety of designs and colors coordinated with, or contrasting to, the straps of the garment with which they are being worn.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bra and bra strap clasp system for coupling ends of bra shoulder straps to the cup sections of the bra, the system comprising, in combination:

a bra having two shoulder straps, each shoulder strap being divided into an upper shoulder strap section and a lower cup strap section, the upper shoulder strap section having an end with a fixed loop, the lower cup strap section having an end with a fixed loop, the fixed loops being of a common size, the shoulder straps and the loops being fabricated of a flexible fabric material;

a thin layer of a flexible elastomer covering the loops to provide durability and a lubricious surface;

two similarly configured clasps, each clasp having a front face and parallel rear face separated by a thickness, each clasp having an exterior periphery and an interior opening, the interior opening being formed with a linear upper bearing surface and a parallel linear lower bearing surface, an interior joining surface and a parallel exterior joining surface, the interior and exterior joining surfaces coupling the upper and lower bearing surfaces;

a linear slot formed in each clasp extending between the exterior periphery and the interior joining surface, each slot being essentially midway between the bearing surfaces and at an acute angle with respect to the bearing surfaces, each slot having a width to allow adjacent loops of a bra strap to pass between an operative orientation and an inoperative orientation, the operative orientation coupling the strap sections with portions of the loop within the interior opening of the clasp in contact with the bearing surfaces, and wherein the inoperative orientation is where the strap sections are exterior of the clasps.

* * * * *